US008717426B2

(12) United States Patent
Zamora et al.

(10) Patent No.: US 8,717,426 B2
(45) Date of Patent: May 6, 2014

(54) LIQUID AND SOLIDS ANALYSIS OF DRILLING FLUIDS USING FRACTIONATION AND IMAGING

(75) Inventors: Mario Zamora, Houston, TX (US); Marc A. Churan, Houston, TX (US); Zhen Zhu, Houston, TX (US)

(73) Assignee: M-I LLC, Houston, TX (US)

( * ) Notice: Subject to any disclaimer, the term of this patent is extended or adjusted under 35 U.S.C. 154(b) by 1333 days.

(21) Appl. No.: 12/122,423

(22) Filed: May 16, 2008

(65) Prior Publication Data

US 2008/0283296 A1 Nov. 20, 2008

Related U.S. Application Data

(60) Provisional application No. 60/938,485, filed on May 17, 2007.

(51) Int. Cl.
*H04N 9/47* (2006.01)

(52) U.S. Cl.
USPC ..... 348/61

(58) Field of Classification Search
USPC ..... 348/61
See application file for complete search history.

(56) References Cited

U.S. PATENT DOCUMENTS

| | | | | |
|---|---|---|---|---|
| 5,470,710 | A * | 11/1995 | Weiss et al. | 435/6.12 |
| 6,525,003 | B2 * | 2/2003 | Schlemmer et al. | 507/103 |
| 7,422,693 | B2 * | 9/2008 | Carter et al. | 210/745 |
| 7,475,732 | B2 * | 1/2009 | Hosie et al. | 166/373 |
| 2002/0061823 | A1 * | 5/2002 | Schlemmer et al. | 507/269 |
| 2002/0175681 | A1 * | 11/2002 | Taicher | 324/303 |
| 2004/0071330 | A1 * | 4/2004 | Curry | 382/133 |
| 2004/0090230 | A1 * | 5/2004 | Appel et al. | 324/307 |
| 2004/0112595 | A1 * | 6/2004 | Bostick et al. | 166/250.01 |
| 2004/0129424 | A1 * | 7/2004 | Hosie et al. | 166/332.8 |
| 2005/0051466 | A1 * | 3/2005 | Carter et al. | 210/94 |
| 2006/0039010 | A1 * | 2/2006 | Reese et al. | 356/601 |
| 2006/0050146 | A1 * | 3/2006 | Richardson | 348/80 |
| 2006/0102342 | A1 * | 5/2006 | East et al. | 166/250.1 |
| 2007/0025727 | A1 * | 2/2007 | Matusik et al. | 396/505 |
| 2007/0120051 | A1 * | 5/2007 | DiFoggio et al. | 250/269.1 |
| 2007/0139541 | A1 * | 6/2007 | Fein et al. | 348/294 |
| 2007/0205000 | A1 * | 9/2007 | Hosie et al. | 166/374 |
| 2008/0239458 | A1 * | 10/2008 | Sachs et al. | 359/294 |
| 2008/0245953 | A1 * | 10/2008 | Reese et al. | 250/208.1 |
| 2008/0283296 | A1 * | 11/2008 | Zamora et al. | 175/48 |
| 2009/0295963 | A1 * | 12/2009 | Bamford et al. | 348/302 |

* cited by examiner

*Primary Examiner* — Jerry Dennison
(74) *Attorney, Agent, or Firm* — Osha Liang LLP

(57) ABSTRACT

A method of determining drilling fluid contents including fractionating a fluid sample, wherein the fluid sample includes a drilling fluid, and collecting image data from the fractioned fluid sample. Furthermore, processing the image data with a process station to produce a rendered image, and outputting the rendered image. Additionally, a system for determining drilling fluids content including an image gathering vessel having a holding section and an image gathering device operatively coupled to the image gathering vessel for collecting image data from a fluid sample, wherein the fluid sample includes a drilling fluid. Furthermore, a processing station for receiving the image data from the image gathering device and for producing a rendered image of the fluid sample based on the image data.

20 Claims, 4 Drawing Sheets

LIQUID AND SOLIDS ANALYSIS OF DRILLING FLUIDS USING FRACTIONATION AND IMAGING

CROSS REFERENCE TO RELATED APPLICATIONS

This Application claims the benefit of the following application under 35 U.S.C. 119(e); U.S. Provisional Application Ser. No. 60/938,485 filed on May 17, 2007, incorporated by reference in its entirety herein.

BACKGROUND

1. Field of the Disclosure

The present disclosure generally relates to methods and apparatus for characterizing the liquid and solids content of drilling fluids. More particularly, the present disclosure relates to methods and apparatus for characterizing the liquid and solids content of drilling fluids using digital photography. More particularly still, the present disclosure relates to methods and apparatus for d characterizing the liquid and solids content of drilling fluids using fractionation and multi-spectral.

2. Background Art

Wellbore drilling fluids serve many functions throughout the process of drilling for oil and gas. Primary functions include controlling subsurface pressures, transporting to the surface "cuttings" created by the drill bit, and cooling and lubricating the drill bit as it grinds through the earth's crust. Most of the cuttings are removed at the surface by different types of solids-removal equipment, by small bits of formation, such as clays and shales, are invariably incorporated into the drilling fluid as "low-gravity" solids. These low-gravity solids are generally undesirable in that they can contribute to excess viscosity and can adversely impact chemical treatment of the drilling fluid so that it can satisfy other critical functions. The low-gravity solids also are distinguished from high-gravity solids that are added intentionally to increase the density of the drilling fluid.

Fluid density, or mass per unit volume, controls subsurface pressures and contributes to the stability of the borehole by increasing the pressure exerted by the drilling fluid onto the surface of the formation downhole. The column of fluid in the borehole exerts hydrostatic pressure proportional to the true vertical depth of the hole and density of the fluid. Therefore, one can stabilize the borehole and prevent the undesirable inflow of formation fluids by maintaining a proper density of the drilling fluid to ensure that an adequate amount of hydrostatic pressure is maintained.

Several methods of controlling the density of wellbore fluids exist. One method adds dissolved salts such as sodium chloride and calcium chloride in the form of an aqueous brine to drilling fluids. Another method involves adding inert, high specific gravity particulates to drilling fluids to form a suspension of increased density. These inert high-density particulates are often referred to as "weighting agents" and typically include particulate minerals of barite, calcite, or hematite.

While maintaining the density of a drilling fluid is important, other factors also influence the effectiveness of specific drilling fluids in certain drilling operations. Such other factors may include viscosity and composition of the drilling fluid, as well as the fluids ability to cool and lubricate the drill bit. To determine the most effective drilling fluid for a given drilling operation, it is necessary to measure the chemical and physical properties of the drilling fluid as a returns from downhole.

Presently, the standard method for determining the liquid and solids content of the drilling fluid is to conduct a retort analysis. In a retort analysis, a drilling fluid sample is heated at sufficient temperature to vaporize contained liquids, including water, oil, or synthetics. The liquids are condensed, after which the specific volumes can be measured directly in a graduated cylinder. Oil and synthetics have a lower specific gravity than the water and will separate naturally in the measuring container. The total volume of liquids then is subtracted from the starting drilling volume to determine the total solids content. Appropriate mathematical functions are then applied in context of the general composition of the drilling fluid to estimate the fraction of high-gravity and low-gravity solids.

Due to the heating requirements, current retort practices are known to be potentially dangerous, and subject to inaccuracies and inconsistencies. Furthermore, the retort method does not provide means to characterize and differentiate the different solid components beyond the general categorization by gross specific gravity.

Accordingly, there is an existing need for an effective method of characterizing liquid and solid content of drilling fluids.

SUMMARY OF THE DISCLOSURE

In one aspect, embodiments of the present disclosure include a method of determining drilling fluid contents including fractionating a fluid sample, wherein the fluid sample includes a drilling fluid, and collecting image data from the fractioned fluid sample. Furthermore, processing the image data with a process station to produce a rendered image, and outputting the rendered image.

In another aspect, embodiments of the present disclosure include a system for determining drilling fluids content including an image gathering vessel having a holding section and an image gathering device operatively coupled to the image gathering vessel for collecting image data from a fluid sample, wherein the fluid sample includes a drilling fluid. Furthermore, a processing station for receiving the image data from the image gathering device and for producing a rendered image of the fluid sample based on the image data.

Other aspects and advantages of the disclosure will be apparent from the following description and the appended claims.

DETAILED DESCRIPTION

Figure 1:
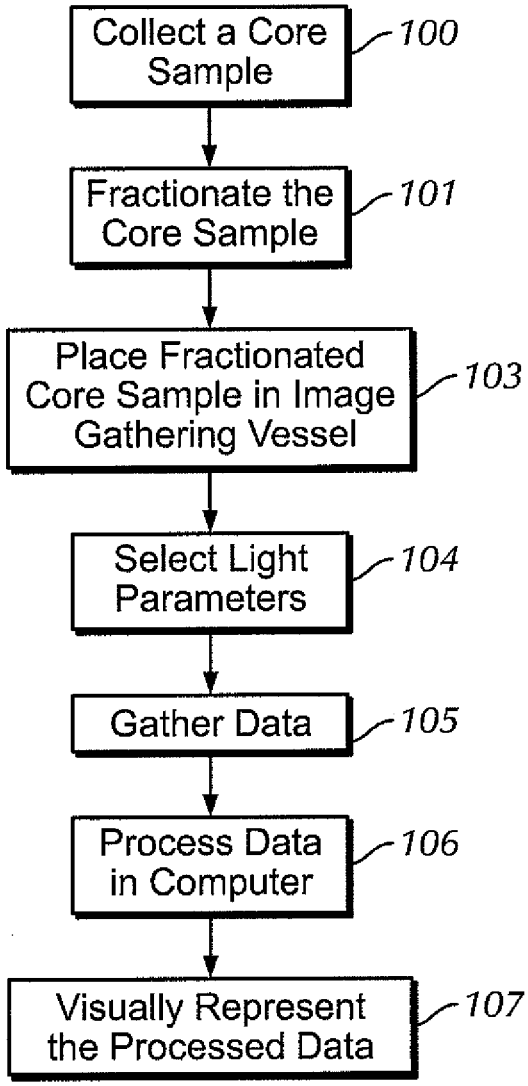
FIG. 1 shows a block diagram of a method according to one embodiment of the present disclosure.

Embodiments disclosed herein generally relate to methods and apparatus for characterizing liquid and solid content of drilling fluids. More particularly, embodiments disclosed herein relate to methods and apparatus for characterizing liquid and solid content of drilling fluids using digital photography. More particularly still, embodiments disclosed herein relate to methods and apparatus for characterizing liquid and solid content of drilling fluids using multi-spectral imaging and fractionation, Referring to FIG. 1, a block diagram of a method according to one embodiment of the present disclosure is shown. Initially, before a drilling fluid can be analyzed, a drilling operator or technician must collect a fluid sample 100. As used herein, a fluid sample refers to a small volume of drilling fluid that has been used in a drilling operation or has been mixed in the laboratory or in a mixing plant. Generally, drilling fluid samples contain a mixture of liquids with particulate matter suspended therein. Suspended particulate matter may include low-gravity additives, such as clays and organic chemicals, low-gravity contaminants, such as drill cuttings, clay, shale, and high-density inert solids and dissolved salts used to increase density. Drilling fluid samples in the field or in a mixing plant may be collected in a number of ways, such as, for example, by collection in a "mud cup" or other suitable container. Those of ordinary skill in the art will appreciate that substantially similar collection methods may be used in collecting a fluid sample as would traditionally be used to collect a fluid sample for retort analysis.

After collecting the fluid sample, the fluid sample is fractionated 101. The fractionation of the fluid sample may occur according to several methods. In one embodiment, the fluid sample is placed in a test tube and inserted in a high-speed centrifuge. High-speed centrifuges, as are known in the art, are capable of reaching speeds in excess of 30,000 revolutions per minute ("RPM") that create centrifugal forces in excess of 60,000 G-forces ("G's") to a fluid sample. In a particular embodiment, the fluid sample is centrifuged at approximately 12,000 RPM and 15,000 G's, such that oil and water are separated from the solids, and the solids are layered depending on their specific gravity and size.

Centrifuge fractionation allows for the separation of the fluid sample according to a gradient based on the specific gravity of the components. Thus, after centrifuging the fluid sample, the components of the fluid sample will be layered according to their specific densities. One of ordinary skill in the art will appreciate that the speed of the centrifuge may be varied to achieve the required separation of components of the fluid sample (i.e., obtaining fractional purity) while also allowing the components to be collected together. Preferably, after fractionation, the components of the fluid sample will be dispersed in the test tube, or other collection media, so that substantially all of an individual component is layered according to relative density. The more distinct the layering (i.e., the greater the fractional purity) the more readily distinguishable the components will being during subsequent processing. In other embodiments, those of ordinary skill in the art will appreciate that retort analysis may be used instead of centrifugation to separate oil and water content from the solids, but without distinguishing the separate solid components. And in still other embodiments, other methods of physical separation known in the art may be used to divide the fluid sample into its component parts.

After fractionation, the fluid sample is placed in an image gatherer 103. The image gathering vessel, generally, includes a holding section within which the fluid sample may be placed. The holding section is adapted to receive an image gathering device (e.g., a digital camera), such that when the image gathering device is connected to the holding section, substantially all light is prevented from entering the holding section. The image gatherer may also include a number of components part, such as, for example, baffles, optical filters, lenses, and specialized lighting, that will be discussed in greater detail below.

Once the fluid sample is secured in the image gatherer, the operator selects appropriate light conditions for the procedure 104. Depending on the wavelength of light being collected from the fluid sample, the type of light selected may vary. For example, for certain image gathering operations, full spectrum light may be appropriate, and in such operations, natural light may be allowed to enter the holding section of the image gatherer. However, in other operations, substantially all natural light may be excluded from the holding section to prevent contamination of the image. In still other operations, lighting may be added to the holding section to stimulate a desired response form the fluid sample, for example, fluorescence. One of ordinary skill in the art will appreciate that certain operations may involve gathering multiple images, and as such, the light conditions in the holding section, as well as the image gathering devices may vary according to the specific image gathering process being used.

After an operator selects appropriate light parameters, image data is gathered from the fluid sample 105. Gathering the image data may vary according to the type of image gathering device being used. However, image gathering may generally include taking a predetermined number of images at differing wavelengths and/or times, from generally the same inclination. One of ordinary skill in the art will appreciate that the term "images" as used herein, refers to image data gathered from fluid samples according to any image gathering device including, but not limited to, infrared cameras, digital cameras, multichannel cameras, charge-coupled device cameras, multi-spectral imaging cameras, polarized cameras, and monochrome cameras. As such, characteristics of the images may vary according to the specific image gathering device being used.

The gathered data is then transferred to a processing station 106. In one embodiment, the processing station may be as straight forward as a laptop computer operatively coupled to the image gathering device by, for example, standard USB cables, as are known in the art. However, in other embodiments, the processing station may include remote access and/or networked computer terminals located either in other areas of the drill site, or at central processing station located off site. The specific processing techniques of the raw gathered image data will vary according to the type of image gathering device used, however; generally, software will provide instructions for the processing equipment to render images representing the gathered data. In one embodiment, the gathered image data is loaded into a computer, and the computer renders on-screen images displaying the fluid may include a two-dimensional rendition of the fluid sample under a single wavelength of light. However, if the image gathering device was a multi-spectral imaging device, then the image rendition may include complex layering of the fluid sample from a number of different angles at a number of different wavelengths of light. Thus, a multi-spectral imaging device may provide several images of varying depth and detail superimposed according to component part and/or other properties as will be discussed below.

Furthermore, one of ordinary skill in the art will appreciate that the type of processing station may be selected based on the type of image gathering device being used. For example, in an operation using a digital camera, the raw image data collected may generally include 512×512 pixels of information and raw spectrum data comprising several megabytes of data. Additional images, such as infrared images and/or ultraviolet images may further increase the amount of data collected.

Additionally, one of ordinary skill in the art will appreciate that image data may be rendered in several software programs to determine specific component properties. For example, one program may enhance the image, while a secondary program classifies the components of the fluid sample based on, for example, color densities, reflexivity, responses to ultra-violet light, and responses to infrared light etc. Other processing programs may render the images into viewable data such that a drilling operator may view the images, and using their expertise, classify the components of the fluid sample. According to still other embodiments, a processing program may suggest component parts of the fluid sample based on the above mentioned classification parameters, then prompt the operator for confirmation. Moreover, one of ordinary skill in the art will appreciate that computer analysis may further provide for classification of the fluid sample according to type and/or percentages of water, oil, and solids content, as well as characterizing fluid sample components according to densities and/or material properties (e.g., solubility, hardness, particulate size).

After the raw image data is processed, the data is visually represented 107. According to the type of data, and the requirements of the operation, the type of visual representation may be adjusted. Generally, in an embodiment using a digital camera and a computer, the visual representation may include listing the component parts in graphical or lexicographic form, while displaying a rendered image. By providing both a visual representation as an image and as calculated/measured data, an operator may check the calculations/measurements of the processing program. Additionally, the rendered image may be output to a printing device so that a copy of the image may be displayed, saved, recorded, or used as a redundancy check in the same or other drilling operations. Furthermore, by displaying the data in both graphical and image states, the data may be saved appropriately according to the specific operation. For example, in an operation where storage requirements of the processing system is a significant consideration, graphical data may preferably be stored instead of rendered image data to save file space. However, on large networked servers, it may be preferable to save both the graphical and rendered image data so that the data may be used in subsequent operations.

One of ordinary skill in the art will appreciate that visual representation of the image may include displaying the raw image data as a rendered representation, or modifying the image data to display the image according to defined parameters. Such parameters may include, for example, image size, light properties, rendition lines, component segmentation indicators, and labels. Additionally, in certain embodiments, characterizations of the fluid sample may be indicated on the images by, for example, the addition of colors, shading, or filters.

In addition to displaying a visual representation of the image, the image may be displayed contemporaneous to other images for comparative value. For example, an image displaying a known substance may be displayed proximate an image of an unknown fluid sample. An operator may then compare the images to determine a component of the unknown fluid sample. One of ordinary skill in the art will appreciate that such comparative data may also include comparing graphical or lexicographic data sets.

In some embodiments, the visually represented data may include an analysis of the components of the fluid sample. For example, a visual output may include a description of the analyzed contents of the fluid sample in terms of percent by volume of the fluid sample of present components. In one embodiment, a visual output may indicate that the fluid sample is comprised of a water, an oil, a high-density solid, and a low density solid, and provide calculated percentages by volume for each. In other embodiments, high-density solids may be divided into specific components, and the components thereby characterized according to specific properties. One of ordinary skill in the art will appreciate that the data collected and the methods of displaying the data may vary according to the specific requirements of a certain operation.

Figure 7:
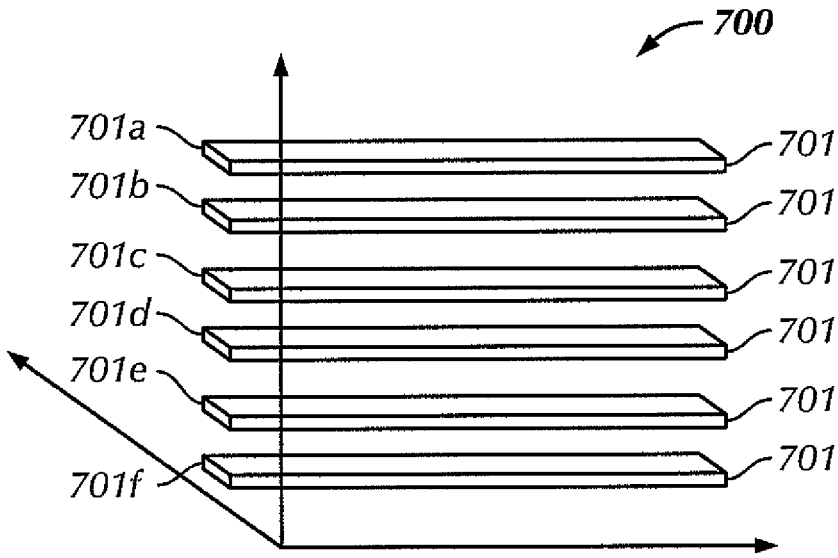
FIG. 7 shows a representation of a rendered image in accordance with one embodiment of the present disclosure.

Referring briefly to FIG. 7, a rendered image 700 produced by an embodiment of the present disclosure is shown. Rendered image 700, as illustrated, is representative of a rendered image 700 which would be produced by a multi-spectral image gathering device. In this embodiment, rendered image 700 includes six component images 701 superimposed over one another. Component images 701 may includes images takes at different wavelengths of light, with different optical filters, or at different time intervals. Thus, in one embodiment, each of components images 701 may be captured at a different wavelength of light. For example, one component image may be taken in the infrared region 701*a*, one in the near infrared region 701*b*, three in the visible region 701*e-e*, and one in the ultraviolet region 701*f* of the electromagnetic spectrum. By layering individual images 701*a-f* image over one another, a component image 701 may allow a drilling operator to discern differences in drilling fluid components. As such, a drilling operator, or a computer software program, may be able to determine the composition of a drilling fluid, including, but not limited to, a percent volume of water, a percent volume of oil, and a percent volume of a solids content. Moreover, in certain embodiments, specific solids may be determinable due to the specific properties of the solid components when analyzed under multiple wavelengths of light. Examples of such properties include differences illustrated in component image 701, such as, differences in coloration, fluorescence, and reflectivity.

While component image 701 is illustrative of a rendered image that may be produced by an embodiment of the present disclosure including a multi-spectral image gathering device, those of ordinary skill in the art will appreciate that other types of rendered images are within the scope of the present disclosure. Examples of other rendered images include, digital photographs, single layer images, vector images, grayscale images, palette images, 3-dimensional images, fluorescence imagery, and other types of rendered images as would be known to those of ordinary skill in the art. Furthermore, tabular data indicating specific properties of the drilling fluid and/or composition of the solid components may be included as a part of a rendered image. An example of such tabular data may include a table listing the properties of the drilling fluid. In still other embodiments, the rendered image may include a photographic printout that is analyzed by a drilling operator rather than a computer to determine the specific drilling fluid properties.

While the above described method generally describes one application of the present disclosure, those of ordinary skill in the art will appreciate that for a given operation, different image gathering devices, processing station components, or modifications to the image gathering vessel, whether in combination or alone, are foreseen, and within the scope of the present disclosure. Furthermore, the above described method may be practiced on location at a drilling rig, at a location remote to the drilling rig, or in a lab during subsequent analysis of drilling fluid samples.

Figure 2:
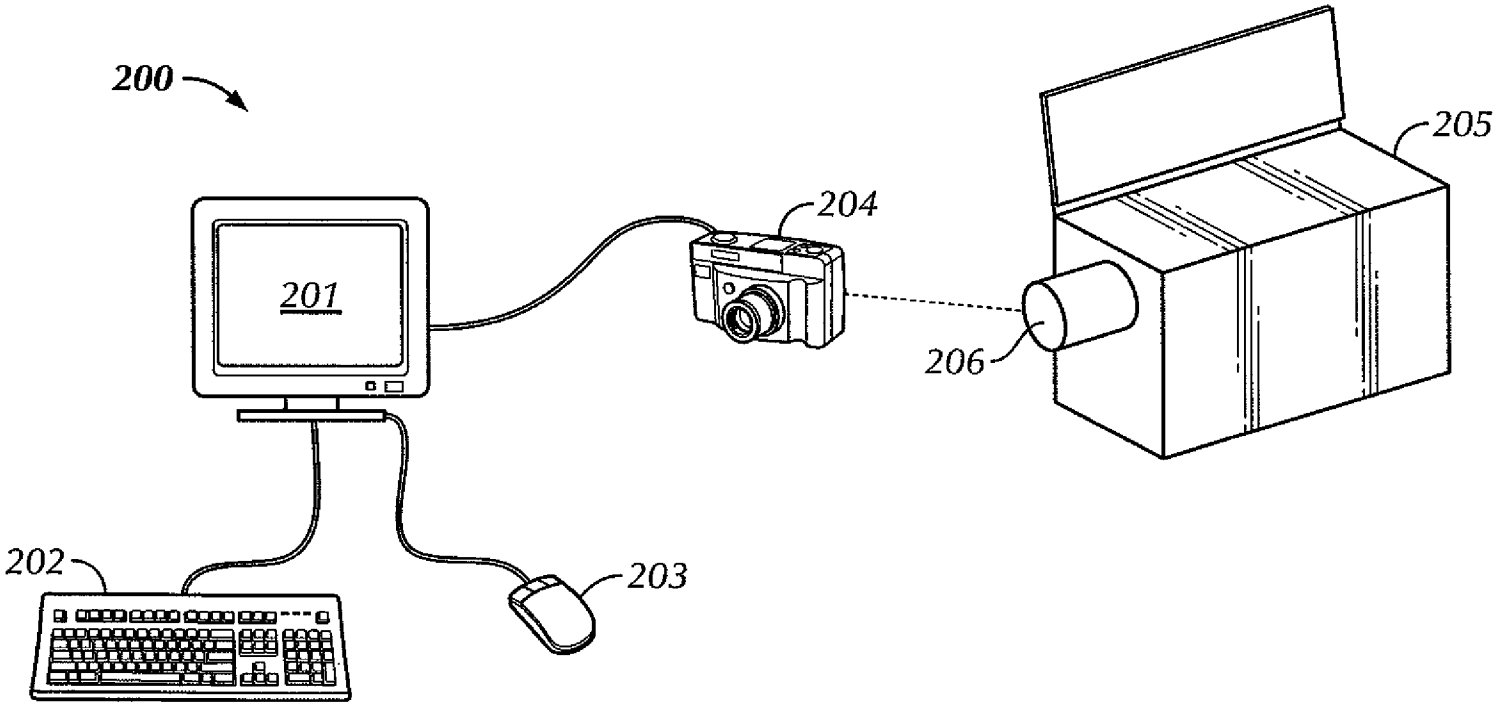
FIG. 2 shows a component schematic of one embodiment of the present disclosure.

Referring to FIG. 2, a component schematic of one embodiment of the present disclosure is shown. In this embodiment, a system 200 for determining drilling fluid content is illustrated as may occur in a basic set-up. In system 200, a computer 201 is coupled to multiple peripheral devices, such as a keyboard 202 and a mouse 203, which are used to input data into computer 201. An image gathering device 204, in this case a digital camera, is operative coupled to computer 201 by way of, for example, a USB cable, or other connection methods known in the art. Image gathering device 204 is shown disposed proximate an image gathering vessel 205. Image gathering vessel 205 includes an optical extension 206 for coupling image gathering device 204 to image gathering vessel 205. Image gathering device 204 may be coupled to optical extension 206 according to any method known in the art, such as, for example, threaded lenses or clamp brackets.

In operation, a fluid sample is disposed in image gathering vessel 205 after fractionation, as described above. The operator couples image gathering device 204 to image gathering vessel 205 and ensures that residual light is abated from entering image gathering vessel 205 through the connection of image gathering device 204 to optical extension 206. The operator then closes image gathering vessel 205, and adjusts the light communicated to the fluid sample, as described above. When appropriate lighting conditions are established, the operator activates the image gathering, which in the present operation, involves taking one or a series of pictures with image gathering device 204. The pictures are then transferred from image gathering device 204 to computer 201. Software instructions in computer 201 process and analyze the data, thereby computing a rendered image. In this embodiment, the rendered image is displayed on computer 201 as a combination of graphical, lexicographic, and/or pictorial image data. Image gathering device 204 may then be reset and additional pictures may be taken. Or, in some embodiments, image gathering device 204 may be exchanged with another type of image gathering device 204, such as, for example, a multi-spectral imaging device, and additional image data may be captured. In such an embodiment, the additional image data from a secondary image gathering device (not shown) may be communicated to computer 201 for additional rendering. Computer 201 may then superimpose the secondary image data over or with the first image data to create a composite rendered display, as previously described.

While computer 201, and peripheral devices 202 and 203 are illustrated as independent components, one of ordinary skill in the art that all three components are merely exemplary of processing station components that a system 200 in accordance with the present disclosure may use. In other embodiments, computer 201 may be a laptop, a server, a supercomputer, or any other type of processing station capable of analyzing and rendering image data. In other embodiments, image gathering device 204 may not be directly connected to computer 201, but connected to an offsite or a remote processing station via wireless communication methods. Examples of such wireless communication methods may include, for example, modems, high-speed broadband data structures, or other wireless network components. In still other embodiments, image gathering device 204 may be connected to a computer 201, and computer 201 may communicate image data to an offsite or remote processing station by any of the previously described methods. Thus, one of ordinary skill in the art will appreciate that different configurations of computer 201, image gathering device 204, and image gathering vessel 205 are contemplated and as such, are expressly within the scope of the present disclosure.

Figure 3:
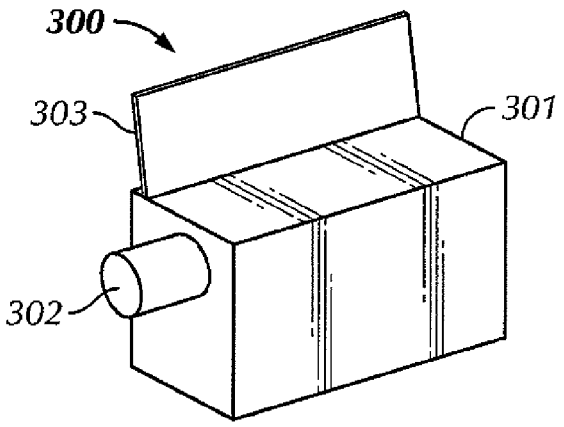
FIG. 3 shows a perspective view of an image gathering vessel in accordance with one embodiment of the present disclosure.

Referring now to FIG. 3, a perspective view of an image gathering vessel 300 in accordance with one embodiment of the present disclosure is shown. In this embodiment, image gathering vessel 300 includes a holding section 301, an optical extension 302, and a closing member 303. Holding section 301 may be of any size capable of holding and securing a fractionation test tube in place during image gathering. Examples of appropriate sizes of fractionation test tubes may generally include sized test tubes similar to those used in retort analysis (e.g., 10, 20, or 50 $cm^3$). However, those of ordinary skill in the art will appreciate that other sized test tubes may be appropriate depending on the specific requirements of a certain operation. The internal structure of holding section 301 may include structures similar to test tube racks, or other holding components (not shown) known in the art. Furthermore, holding section 301 may include bracketing or holding structures to secure additional components, such as, for example, internal optical filters, baffles, light restriction members, and internal image gathering devices attached within holding section 301.

In this embodiment, image gathering vessel 300 includes optical extension 302 as a way of attaching an image gathering device to image gathering vessel 300. Optical extension 302 is illustrated as generally cylindrical in nature to accommodate a typical geometry of a lens of an image gathering device. However, those of ordinary skill in the art will appreciate that the geometry of optical extension 302 may be of other shapes, such as, cubic, and need not necessarily protrude from holding section 301. In some embodiments, optical extension 302 may extend into holding section 301, or may include movement mechanisms to move the lens of an image gathering device through optical extension 302 into holding section 301. Other embodiments of optical extensions 302 may include additional means for restricting the communication of light into holding section 301. As such, one of ordinary skill in the art will appreciate that any geometry or configuration of optical extension 302 is within the scope of the present disclosure, including embodiments not using optical extensions 302.

Also attached to holding section 301 is closing member 303, In this embodiment closing member 303 is illustrated as a hinged structure supported on a single side of holding section 301. However, closing member 303 may be supported or extend from multiple sides of holding section 301, and may be secured through any method known in the art. In some embodiments, light restricting or cushioning components such as gaskets or seals made of rubbers or foams may be disposed on the external perimeter of closing member 303 to further restrict the flow of light into holding section 301. Alternatively, closing member 303, when secured to holding section 301, may rest upon light restricting components (not shown) that are disposed along an internal perimeter of holding section 301.

Figure 4:
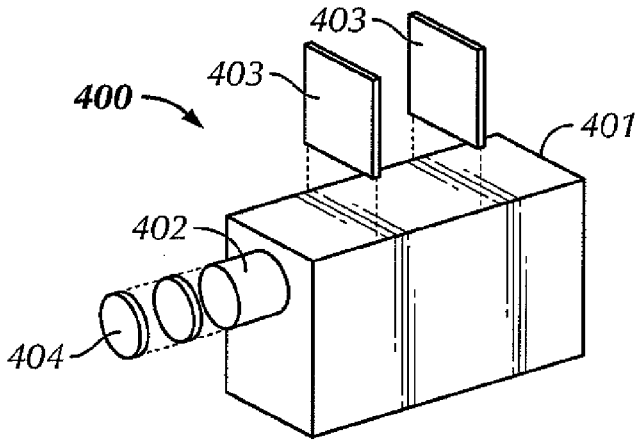
FIG. 4 shows a perspective view of an image gathering vessel in accordance with one embodiment of the present disclosure.

Referring now to FIG. 4, a perspective view of an image gathering vessel 400 in accordance with one embodiment of the present disclosure is shown. In this embodiment, image gathering vessel 400 includes a holding section 401 and an optical extension 402. This embodiment does not specifically illustrate a closing member, as described above, however, those of ordinary skill in the art will appreciate that a closing member may be added to restrict light and/or secure a fluid sample within holding section 401.

Figure 5:
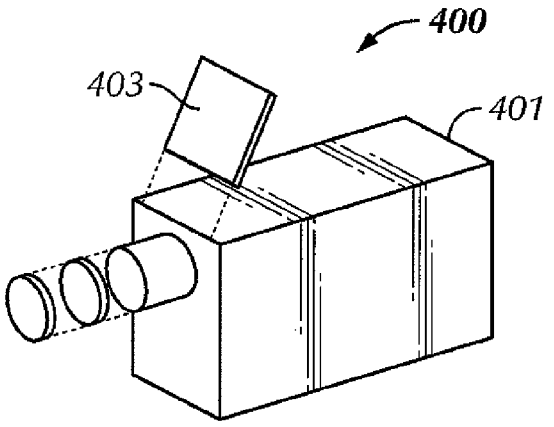
FIG. 5 shows a perspective view of an image gathering vessel in accordance with one embodiment of the present disclosure.

In this embodiment, a series of baffles 403 are disposed inside holding section 401. The baffles are placed inside holding section 401 generally perpendicular to the base of holding section 401, and when in place, may restrict light from accessing certain sections of holding section 401. Referring briefly to FIG. 5, in an alternate embodiment, baffles 403 may be disposed with an angular orientation so as to restrict light access directed to a specific section of holding section 401. Such an angular orientation may allow baffles 403 to be disposed along side walls of holding section 401, or in embodiments with closing members, as extensions protruding therefrom. While baffles 403 generally are used to block stray light, those of ordinary skill in the art will appreciate that by coating baffles 403 with specific coatings, and/or fabricating baffles 403 from specific materials, reflectivity of the surface of the fluid sample may be reduced. Also, baffles 403 may provide additional structural rigidity to image gathering vessel 400, as well as helping maintain constant temperature and environmental conditions within holding section 401.

Referring back to FIG. 4, a series of optical filters 404 is shown in perspective, disposed laterally extending from optical extension 402. Generally, optical filters may be coupled to optical extension 402 such that when an image gathering device is connected to image gathering vessel 400, light is restricted or modified accordingly. Those of ordinary skill in the art will appreciate that that optical filters 404 may be coupled to either optical extension 402 or proximate a lens of an image gather device by threadable connection, bracketing, or via any other attachment method known in the art.

Optical filters 404 are generally used to adjust light entering a lens or to modify the imaging bands that reach a prism of a image gathering device (e.g., in multi-spectral imaging). Thus, as long as a targeted image band of a fluid sample falls within the spectral band created by a prism of an image gathering device, the targeted image band may be selected by adjusting the pass bands of optical filter 404. One method of adjusting the pass bands may be to select an optical filter 404 of appropriate wavelength. In determining the type of optical filter 404 with appropriate pass bands to select a targeted image band, one of ordinary skill in the art will appreciate that optical filters are commercially available to selectively pass different wavelengths of light, such as, for example, light in the 450-900 nm range. Additionally, customized optical filters may be fabricated to further select a targeted image band. The above-described optical filters 404 are only one type of optical filter 404 that may be used in the present application. Those of ordinary skill in the art will appreciate that in other embodiments, ultra-violet filters, glare reduction filters, polarization filters, or other filters may also be used to control the wavelength of the light reaching a lens or otherwise modify the light reaching a lens or prism of the image gathering device.

Figure 6:
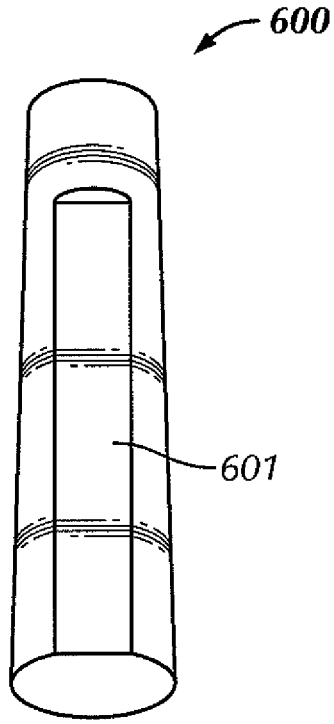
FIG. 6 shows a perspective view of a fractionation test tube in accordance with one embodiment of the present disclosure.

Referring now to FIG. 6, a perspective view of a fractionation test tube 600 in accordance with one embodiment of the present disclosure is shown. In this embodiment, fractionation test tube 600 is generally cylindrical in geometry, however, one surface has a substantially flat portion 601. Substantially flat portion 601 allows fractionation test tube 600 to be inserted into an image gathering vessel with flat portion 601 facing an image gathering device. Typically, when photographing test tubes of generally cylindrical geometry, the image produced by the photograph will exhibit some degree of parallax. Parallax occurs because of the curves in the glass of the cylindrical test tubs. Thus, by having a test tube with flat portion 601, parallax may be minimized, thereby creating more true images of the fluid sample. Those of ordinary skill in the art will appreciate that by decreasing parallax, image rendering software may better analyze that contents of the fluid sample, thereby providing more accurate results of the contents of a drilling fluid.

Additionally, fractionation test tube 600 may be fabricated from a wide range of materials including, for example, glass, polycarbonate, and fused silica. In certain embodiments, fused silica may provide advantages over other types of test tubes due to specific material properties. Specifically, fused silica is generally translucent, and near infrared light (i.e., wavelengths of light from approximately 700 nm to 1100 nm) may be used to see through and photograph the contents of a fused silica test tube. Furthermore, fused silica is highly alkali-resistant and salt-resisting, both conditions often found in drilling fluids. One of ordinary skill in the art will appreciate that in certain operations, it may be beneficial to photograph a fluid sample using multiple fluid samples in multiple test tubes fabricated from different materials. By using different material test tubes, a more accurate depiction of the properties of the fluid samples may be obtained, and a more accurate resolution of the component parts of the fluid sample may be generated.

In still other embodiments, test tubes may be fabricated from metals and metal alloys. In such embodiments, one or more slits may be left in the side walls of the test tube to allow unimpeded exposure of the fluid sample to the image gathering device. By not having a substrate such as glass or fused silica between the fluid sample and the image gathering device, the chance of misinterpreted information being gathered by the image gathering device is deceased. For example, instances of parallax, refraction, or reflection may be decreased or substantially eliminated.

Embodiments of the present disclosure may use a number of different image gathering devices. Such devices may varied according to the requirements of a specific operation, and in certain operations multiple image gathering devices may be desirable. Additionally, in certain embodiments, chemicals may be added to the fluid sample to enhance and/or allow for differentiation between substances in the fluid sample. For example, in one embodiment a chemical, such as methylene blue, may be added to the fluid sample. Because methylene blue may attached to clay particles, the clay particles y be differentiated from other substances in the fluid sample. Those of ordinary skill in the art will appreciate that in other embodiments, alternative chemicals or additives may be used to enhance other substances in the fluid sample.

Advantageously, embodiments of the present disclosure may provide a more accurate resolution of the contents of a fluid sample of a drilling fluid than presently used techniques. By using digital imagery and rendering, components of a drilling fluid may be analyzed and categorized via a computer system. The rendered images may then be output and the characteristic components of the drilling fluid further analyzed. The increased knowledge of the characteristics of a drilling fluid may provide additional information about downhole conditions including, how well a drilling fluid is cleaning the wellbore, whether a production zone has been reached, and the type of formation being drilling. By increasing a drilling operator's knowledge of parameters of the drilling operation, the drilling operator may make more-informed decisions regarding modifying drilling parameters including modifying properties of the drilling fluid. Additionally, because the present disclosure involves digital imagery to determine the components of a drilling fluid, the potentially dangerous use of retort analysis both in labs and at a drilling location may be decreased or eliminated. Finally, the present disclosure may provide for an easily storable method of collecting information about a drilling operation. Because the analyzed images may be saved in electronic format, a historical record of a drilling operation and the component characteristics of a drilling fluid may be saved. Such data may be useful in subsequent drilling operations, or in evaluating the effectiveness of a drilling fluid in later studies.

While the present disclosure has been described with respect to a limited number of embodiments, those skilled in the art, having benefit of this disclosure, will appreciate that other embodiments may be devised which do not depart from the scope of the present disclosure described herein. Accordingly, the scope of the present disclosure should be limited only by the attached claims.

What is claimed is:

1. A method comprising:

collecting a drilling fluid sample, the drilling fluid sample having been circulated through a wellbore, the drilling fluid comprising liquids and particulate matter suspended therein;

fractionating the drilling fluid sample;

collecting image data from the fractionated fluid sample;

processing the image data with a process station to produce a rendered image; and outputting the rendered image.

2. The method of claim 1, wherein the outputting the rendered image comprises outputting visual representation of the rendered image.

3. The method of claim 2, wherein the visual representation comprises at least one of a group consisting of a picture, a graphical display, and a multi-spectral image.

4. The method of claim 1, wherein the outputting the rendered image comprises communicating the rendered image to a secondary computer.

5. The method of claim 4, wherein the secondary computer is a networked computer located at a remote location.

6. The method of claim 1, wherein the fractionating comprises accelerating the drilling fluid sample in a centrifuge.

7. The method of claim 1, wherein the image data is collected with a digital camera.

8. The method of claim 1, further comprising:

adjusting a light parameter.

9. The method of claim 8, wherein the light parameter is a wavelength.

10. The method of claim 1, wherein the drilling fluid comprises oil, water, and solid components.

11. A system for determining drilling fluids content comprising:

a storage vessel containing circulated drilling fluid from a wellbore;

a fractionating device to receive a fluid sample from the storage vessel and producing a fractionated sample;

an image gathering vessel having a holding section for receiving the fractionated sample;

an image gathering device operatively coupled to the image gathering vessel for collecting image data from the fractionated fluid sample; and a processing station for receiving the image data from the image gathering device and for producing a rendered image of the fluid sample based on the image data.

12. The system of claim 11, wherein the image gathering vessel further comprises baffles to restrict the passage of light into the image gathering vessel.

13. The system of claim 11, wherein the system further comprises optical filters coupled to the image gathering device.

14. The system of claim 11, wherein the system further comprises lenses coupled to the image gathering device.

15. The system of claim 11, wherein the system further comprises light elements coupled to the holding section of the image gathering vessel.

16. The system of claim 11, wherein the image gathering device comprises at least one of a group consisting of an infrared camera, a digital camera, a multi-channel camera, a charge-coupled device camera, a multi-spectral imaging camera, a polarized camera, and a monochrome camera.

17. The method of claim 1, further comprising circulating a drilling fluid from the Earth's surface through the wellbore; and collecting the circulated fluid after the drilling fluid has returned to the Earth's surface.

18. The method of claim 1, wherein fractionating the used drilling fluid sample comprises separating the fluid sample into a liquid phase and a solid phase.

19. The method of claim 18, wherein the fractionating further comprises separating the solid phase into a plurality of solid fractions.

20. The system of claim 11, wherein the system further comprises a drill rig configured to circulate the drilling fluid from the Earth's surface through the wellbore and return the drilling fluid to storage vessel on the Earth's surface.

* * * * *